United States Patent [19]

Hellmers

[11] 4,116,013

[45] Sep. 26, 1978

[54] UNDERWATER PILING RESTORATION SYSTEM

[76] Inventor: Emil Donald Hellmers, 6414 Bayshore Walk, Long Beach, Calif. 90803

[21] Appl. No.: 754,631

[22] Filed: Dec. 27, 1976

[51] Int. Cl.[2] ..... E02D 5/60

[52] U.S. Cl. ..... 405/216

[58] Field of Search ..... 61/54, 50; 52/170, 169; 264/32, 36

[56] References Cited

U.S. PATENT DOCUMENTS

| | | | |
|---|---|---|---|
| 1,157,328 | 10/1915 | Scowden | 61/54 X |
| 1,411,404 | 4/1922 | Camp | 61/54 X |
| 1,566,582 | 12/1925 | Cortes | 61/54 X |
| 1,807,962 | 6/1931 | Cassiere | 61/54 |
| 1,947,413 | 2/1934 | Hay | 61/54 X |
| 2,181,526 | 11/1939 | Upton | 61/54 |
| 3,197,968 | 8/1965 | Castellanos | 61/54 X |
| 3,338,058 | 8/1967 | Young | 61/53 X |

*Primary Examiner*—Dennis L. Taylor
*Attorney, Agent, or Firm*—Flam & Flam

[57] ABSTRACT

A weakened underwater section of deteriorating pile is provided with a concrete splint. One of two companion seal members is first installed below the weakened section. A split tubular form is then installed about the section. The lower end of the form provides the second of the companion seal members that engages beneath the first seal member. The form is supported from above as water is pumped from the form. The buoyant upthrust moves the companion sealing members into firm sealing engagement. After the suspension for the form is adjusted, concrete is poured into the nearly dry form. The concrete mix is not compromised by contamination with seawater and a structurally sound splint is formed.

10 Claims, 7 Drawing Figures

UNDERWATER PILING RESTORATION SYSTEM

FIELD OF INVENTION

This invention relates to piling that is at least partially underwater. More particularly, this invention relates to a system for restoring deteriorating or deteriorated piles.

BACKGROUND OF THE INVENTION

It is ordinarily only a question of time before piles ultimately deteriorate due to infestation, battering, etc. A load-bearing pile that is serviceable more than twenty years may be considered exceptional.

Various methods have been devised for reinforcing deteriorated piles by the aid of concrete splints or collars. U.S. Pat. No. 1,360,986 to Hoopes suggests a method by which a dam is built up around the pile from an excavation at the floor or bottom. Water is pumped out and concrete is poured into a relatively dry form. Underwater excavation is difficult.

More recently, it has been proposed to support a form on the pile itself. Without first removing water from the form, concrete is poured in, causing the water to be displaced. The resultant splint has structural characteristics that may be very substantially compromised. This happens because some undesired mixing with water occurs. The extent of mixing cannot be controlled. Consequently, the structural characteristics of the splint likewise cannot be anticipated.

Seemingly, the intermediate splint method can be improved upon by sealing the form to the pile so that water can be pumped out in preparation for "dry" form pouring. But, once the form is evacuated, very high buoyancy forces tend to destroy the seal. The primary object of the present invention is to provide a simple and practical underwater piling restoration system utilizing a simple yet effective seal for an intermediate pile splint form.

SUMMARY OF THE INVENTION

In order to accomplish the foregoing objective, I utilize the heretofore destructive high buoyancy forces to establish and maintain the seal. For this purpose, I first attach a collar to the lower pile remnant. The collar carries a downwardly converging conical seating element. A split form is then installed about the pile and suspended from above. The form has a lower sealing member positioned to establish a wedging engagement with the collar seating element upon upward movement of the form. As water is removed, buoyancy urges the form upwardly thereby fixing and maintaining the seal. As the form moves upwardly, its suspension is adjusted to support the concrete loaded into the form.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention since the scope of the invention is best defined by the appended claims.

Structural and operational characteristics attributed to forms of the invention first described shall also be attributed to forms later described, unless such characteristics are obviously inapplicable or unless specific exception is made.

Figure 6:
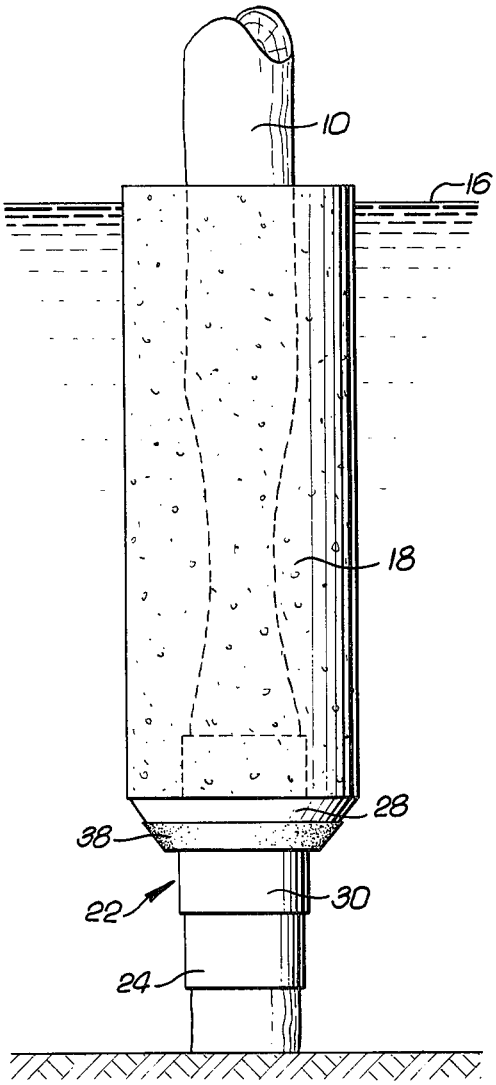
FIG. 6 is a side elevational view of the restored pile.

A deteriorated timber pile 10 is illustrated that may be one element of a piling that supports a pier platform or the like. The pile 10 has a deteriorated or damaged section generally designated by the arrow 14. This section 14 is normally below the waterline 16. In order to restore the pile section 14, a concrete splint 18 (FIG. 6) is cast about the section 14.

Figure 4:
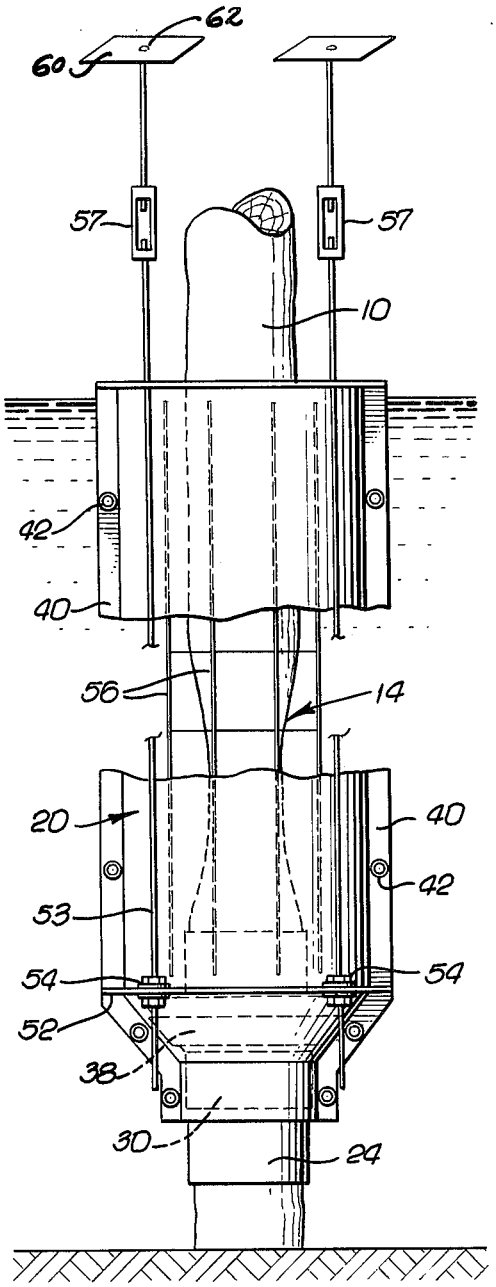
FIG. 4 is an elevational view illustrating the split form suspended preparatory to pouring of concrete, a portion of the form being broken away to illustrate the reinforcing rods.
Figure 5:
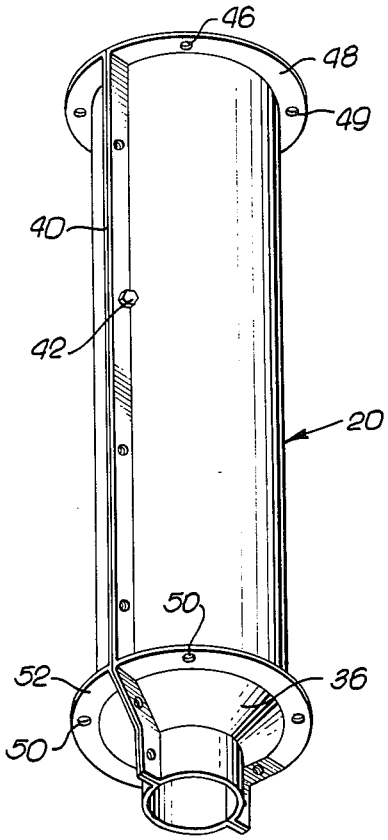
FIG. 5 is a pictorial view of the split form.

In order to cast the splint 18, a form 20 (FIGS. 4 and 5) is secured in encompassing relationship to the pile 10. The lower end of the form 20 is sealed to the stump end of the pile beneath the pile section 14 and its upper end opens above the waterline for receiving the cement mix. The inside of the form is pumped substantially free of water so that the cement mix is relatively uncontaminated by the surrounding water.

Figure 1:
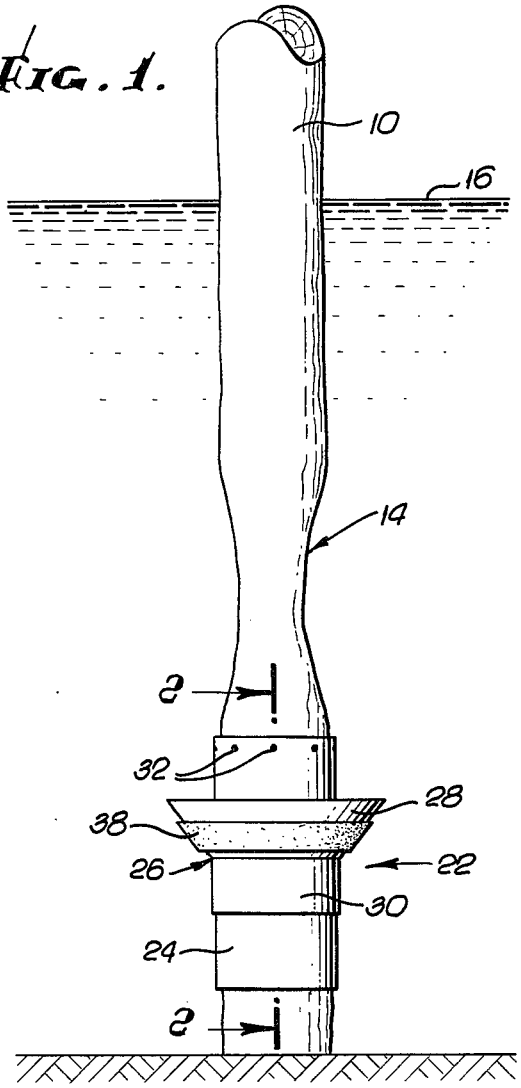
FIG. 1 is an elevational view of a deteriorated piling shown with an attachment collar in position.
Figure 2:
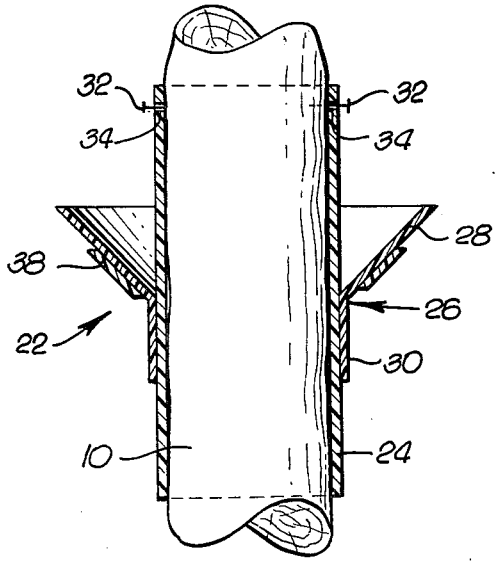
FIG. 2 is an enlarged longitudinal sectional view taken along a plane corresponding to line 2—2 of FIG. 1.
Figure 3:
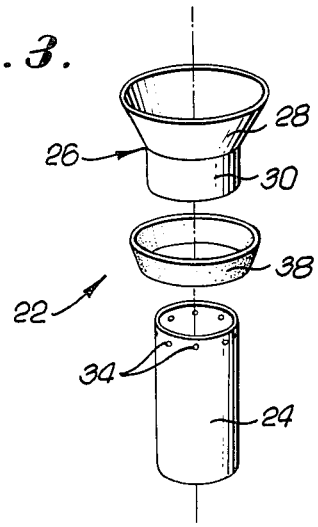
FIG. 3 is an exploded diagrammatic view of the attachment collar.

The form 20 includes an attachment collar 22 (FIGS. 1 and 3) that is first secured in place by a diver. The collar 22 includes a generally cylindrical plastic sleeve 24 that has an internal diameter that reasonably closely fits the pile stump. A plastic seal member 26 is telescoped over the sleeve 24. The seal member 26 has an upper frusto-conical part 28 and a lower cylindrical part 30. The lower part 30 of the seal member 26 is fused or otherwise fastened to the lower end of the sleeve 24. The upper end of the sleeve 24 is secured to the pile stump by nails 32 (FIG. 1) that pass through preformed holes 34 (FIG. 3) in the upper accessible end of the sleeve. The nails 34 anchor the collar and prevent upward vertical movement.

The lower frusto-conical surface of the seal member 26 is nested inside a companion frusto-conical seal member 36 at the lower end of the form 20. Upward thrust on the form 20 wedges the seal members into a tight relationship. A seal strip 38 is interposed between the companion seal elements in order to perfect a reasonably satisfactory seal. The strip 38 may be made of polyurethane foam or the like.

In order to install the form with its lower seal member 36 in encompassing relationship to the attachment collar 22, the form is made of two companion axially split halves. The halves have abutting flanges 40 that cooperate with bolts and nuts 42.

The assembled form 20 is supported from above by rods, in this instance four in number, located about the form. The rods pass through guide apertures 46 (see also FIG. 5) in a top circular flange 48 of the form and alongside the form through apertures 50 in a circular flange 52 near the bottom of the form at the level of the top of the seal member 36. Fasteners 54 couple the suspension rods to the lower flange 50. By means of the rods 53, the form is centered on the pile. The form is long enough so that the splint to be cast extends above the deteriorated or weakened pile section.

Turnbuckles 57 at the upper ends of the suspension rods 53 are interposed between parts of the corresponding rods to serve as a means of adjustment for purposes presently to be described.

After the form is properly in place and a slight upthrust imposed on the form by its suspension rods and its upper end suitably above the waterline, water is pumped from the form. As water is pumped from the form, buoyancy imposes an increasing upward thrust on the form which produces correspondingly increasing sealing pressure between the seal members 26 and 36. The rods 44 move upwardly under the influence of the substantial buoyancy forces. The suspension of the rods is such as to permit this movement. For example, the upper ends of the rods pass with clearance through an anchor plate 60 secured, for example, to the piling platform. Stops 62 on the upper ends of the rods transfer the weight load to the plate 60 while allowing the rods to move upwardly. With all the water removed from the form, the turnbuckles 52 are adjusted to take up the rod slack. The form with the load of concrete mix is supported substantially entirely from above to prevent the imposition of undue strain upon the attachment nails 32.

With the form essentially dry or nearly so, concrete is poured into the form without danger of uncontrolled water contamination. After the concrete is at least partially set, the form 20 is removed. The attachment collar 22, however, remains in place.

If desired, reinforcing rods 56 are secured about the deteriorated pile prior to placement of the form whereby additional flexural strength is added to the splint. In practice, the thickness of the seal member 26 is insufficient to prevent crushing under the high buoyancy forces imposed. Reinforcement is provided by filling the funnel with a hydrophilic mortar.

DESCRIPTION OF MODIFIED EMBODIMENTS

Figure 7:
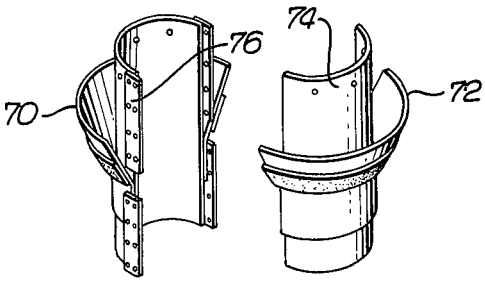
FIG. 7 is a diagrammatic view of a modified split attachment collar.

In the form of the invention illustrated in FIGS. 1 to 6, it is assumed that the top of the pile is accessible for telescoping the attachment collar over it. Alternatively, the weakened intermediate section can be removed for placement of the collar while the upper pile remnant, temporarily without load-bearing capabilities, hangs from the platform. In some instances, it may not be convenient or possible to install the attachment collar in this manner. Accordingly, in the form of the invention illustrated in FIG. 7, the attachment collar is made in two axially split halves 70 and 72. Halves of the sleeve 74 overlap and are lined with sealing strips 76 made of polyurethane foam or the like. Hydrophilic mortar and/or other attachment means may be used at the joints between the collar halves.

Intending to claim all novel, useful and unobvious features shown or described, I make the following claims:

1. The method of casting a concrete splint about a deteriorating underwater section of a pile which comprises:

(a) affixing about the pile at a level beneath the deteriorating section, a first seal member having a downwardly facing sealing element;

(b) placing about the said section and said first seal member, a split elongated hollow form having at its lower end a seal member having an upwardly facing second element opposed to said sealing element of said first seal member;

(c) supporting said hollow form from above the water level;

(d) pumping the water from the form to allow buoyancy forces firmly to establish a sealing relationship between said seal members;

(e) pouring concrete mix into the form while the form is maintained relatively dry;

(f) thereafter removing the form.

2. The method as set forth in claim 1 including the step of allowing the form to move upwardly as it is evacuated, and including the step of adjusting the suspension to bear the weight of concrete admitted into the form while maintaining the established seal.

3. The method as set forth in claim 1 including the step of wedging said seal elements under the influence of buoyancy forces.

4. The method of casting a concrete replacement for a deteriorating underwater section of a pile which comprises:

(a) removing the deteriorating section while supporting the upper pile section;

(b) affixing to the pile stump, a first seal member having a downwardly facing sealing element;

(c) thereafter placing about said stump and said upper pile section, a split elongated hollow form having at its lower end, an upwardly facing second sealing element opposed to said sealing element of said first seal member;

(d) supporting said hollow form from above the water level;

(e) pumping the water from the form to allow buoyancy forces firmly to establish a sealing relationship between said seal members;

(f) pouring concrete mix into the form while the form is maintained relatively dry; and (g) thereafter removing the form.

5. The method as set forth in claim 4 together with the step of allowing the form to move upwardly as it is evacuated, and including the step of adjusting the suspension to bear the weight of concrete admitted into the form while maintaining the established seal.

6. In apparatus for restoring a pile having a deteriorating or deteriorated underwater section:

(a) a first preformed seal member including a generally cylindrical sleeve section designed substantially to fit and to be attached to said pile beneath said pile section;

(b) said first seal member having a seal element having an exteriorly exposed surface that converges downwardly about said pile;

(c) a split form having a second preformed seal member at its lower end of generally funnel shape encompassing said first seal member, said second seal member having an interior surface opposed to said exteriorly exposed surface of said first seal member;

(d) said seal member surfaces being designed to nest and wedge together upon relative axial movement of said seal members;

(e) suspension means attached to said split form for supporting said form as water is evacuated therefrom and as concrete is poured into said form.

7. The combination as set forth in claim 6 in which said form has a peripheral flange near its upper end and a peripheral flange near its lower end, said suspension means comprising in part, a series of rods extended through angularly spaced apertures in the upper flange and tied to the lower flange.

8. The combination as set forth in claim 7 together with an anchor plate adapted to be supported on the piling platform from above the deteriorating pile, said suspension rods having a lost motion connection with said anchor plate to allow upward movement thereof with the form under the influence of buoyancy forces, and means for taking up the slack between said suspension rods and said anchor means preparatory to pouring the form.

9. The combination as set forth in claim 8 in which said slack adjusting means comprises turnbuckles interposed between sections of the corresponding rods.

10. The combination as set forth in claim 6 together with anchor means adapted to be supported on piling structure above the deteriorating pile, said suspension means having a lost motion connection with said anchor means to allow upward movement thereof with the form under the influence of buoyancy forces, and means for taking up the slack between said suspension means and said anchor means preparatory to pouring the form.

* * * * *